US006257967B1

(12) United States Patent
Schultz

(10) Patent No.: US 6,257,967 B1
(45) Date of Patent: Jul. 10, 2001

(54) SHARPENER FOR VENEER KNIFE

(76) Inventor: Jim Schultz, 250 SW. Brislawn Rd., White Salmon, WA (US) 98672

( * ) Notice: Subject to any disclaimer, the term of this patent is extended or adjusted under 35 U.S.C. 154(b) by 0 days.

(21) Appl. No.: 09/520,544

(22) Filed: Mar. 8, 2000

(51) Int. Cl.[7] ..... B24B 23/00

(52) U.S. Cl. ..... 451/349; 451/358; 451/359; 451/419; 451/262; 451/293; 451/192

(58) Field of Search ..... 451/45, 190, 192, 451/193, 194, 234, 235, 261, 262, 263, 293, 349, 358, 359, 419, 420

(56) References Cited

U.S. PATENT DOCUMENTS

| | | | | |
|---|---|---|---|---|
| 332,187 | * | 12/1885 | Comstock | 451/45 |
| 929,785 | * | 8/1909 | O'Brien | 451/45 |
| 2,026,096 | * | 12/1935 | Muhlbauer | 451/419 |
| 2,052,365 | * | 8/1936 | Stukart | 451/419 |
| 2,077,689 | * | 4/1937 | Grobstein | 451/45 |
| 2,742,742 | * | 4/1956 | Barrett | 451/349 |
| 2,993,312 | * | 7/1961 | Holland et al. | 451/349 |
| 3,122,865 | * | 3/1964 | Kolling | 451/349 |
| 3,800,480 | * | 4/1974 | Keating | 451/349 |
| 4,934,108 | | 6/1990 | Hall . | |

OTHER PUBLICATIONS

Brochure —Doyle Tool & Gauge Co. —Lathe Knife Honer —Part No. DT–2040.
Brochure —Doyle Tool & Gauge Co. —Lathe Knife Micro Beveler.

* cited by examiner

*Primary Examiner*—Eileen P. Morgan
(74) *Attorney, Agent, or Firm*—Robert L. Harrington

(57) ABSTRACT

A sharpening tool for a veneer knife has a primary stone and a secondary stone driven by a power head. The secondary stone is inclined at an angle to the primary stone corresponding to the angle of the defined faces of the veneer knife cutting edge. Outrigger supports are provided as gauge and guide members for the sharpening tool. The primary stone engages one face of the cutting edge and the secondary stone engages the other face of the cutting edge. The secondary stone is forcibly engaged with the primary stone and is rotatably driven by the primary stone.

8 Claims, 4 Drawing Sheets

SHARPENER FOR VENEER KNIFE

FIELD OF THE INVENTION

This invention relates to a method and apparatus for sharpening elongate cutting edges such as used for peeling veneer off logs.

BACKGROUND OF THE INVENTION

Plywood is made of multiple laminated sheets of veneer which is a thin layer of wood peeled from a log. The process of producing veneer involves mounting an 8' long log that is substantially cylindrical into a veneer lathe. The log is clamped at its ends and rotated against an 8' long veneer knife. The knife is controllably moved against the log, first peeling off surface portions to round up the log and make it truly cylindrical with the cylindrical axis coinciding with the axis of rotation. Thereafter the knife produces a continuous sheet, e.g., 8' wide and ⅛" thick of the veneer which is conveyed through a cut off knife, cutting the sheet into 4' lengths. After drying, the sheets are stacked, e.g., with three or five sheets to a stack, and glued together to produce the plywood (3 ply, 5 ply, etc.).

The quality of the plywood sheets is dependent on the production of the consistent thickness of the veneer sheets. The consistent thickness of the veneer sheets is largely dependent on the controlled cutting of the log and this requires a veneer knife having a straight, consistently sharpened cutting edge.

Whereas such cutting edges have heretofore been sharpened by hand requiring substantial man hours and significant cost, an objective of the present invention is to automate or partially automate the sharpening process.

BRIEF DESCRIPTION OF THE INVENTION

The preferred embodiment of the present invention is a portable powered sharpening tool that rotatably drives a pair of sharpening stones. The sharpening stones are mounted for cooperative sharpening at the two sides of a cutting edge of a veneer knife.

With reference to the figures, FIG. 2 is an end view of a typical veneer knife 10. The cutting edge 12 is formed by the two angled faces 14, 16. The angled faces are precisely formed which requires precise grinding of the faces 14, 16 when sharpening.

FIG. 6 illustrates a sharpening tool 18 of the present invention mounted onto the cutting edge of the knife. With reference to FIG. 3, it will be noted that a primary rotary sharpening stone 20 is rotatably mounted to and driven by power tool (power head), e.g., an air drill 22. A mounting bracket 24 secured to the air drill rotatably carries a secondary sharpening stone 26. The secondary stone 26 has a biased face 28 that engages an inset face 30 of the primary stone 20. Rotation of the primary stone 20 produces rotation of the secondary stone 26 through engagement of biased face 28 with inset face 30.

As seen in FIG. 6, the bracket 24 carries a rod 32 that extends along the edge 12. The rod 32 carries outrigger clamps 34 including posts (gauge members) 36 that are suspended over but in close proximity to the cutting edge 12.

The tool is mounted with the rim 38 that surrounds inset 30 being supported on face 14 and stone 26 is supported on face 16. The axes 40, 42 intersect the cutting edge 12. A sharpening slurry is applied to the faces 14, 16 and the operator while gripping handles 60, 64 simply moves the tool along the edge as the rotating stones 20, 26 sharpens that edge. The stones have a porous surface, e.g., cast iron, which absorbs the graphite slurry (the slurry becomes imbedded in the pores of the iron).

The invention will be more fully understood upon reference to the following detailed description having reference to the accompanying drawings.

DESCRIPTION OF THE PREFERRED EMBODIMENT

Figure 2:
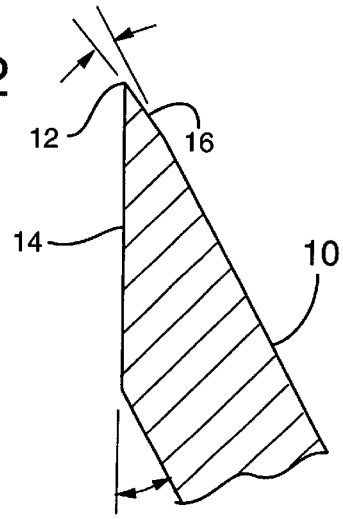
FIG. 2 is an end view of a veneer knife such as sharpened by the tool of FIG. 1.

FIG. 2 is an end view of a veneer knife 10 that has a cutting edge 12 defined by the inclined faces 14, 16. The cutting edge 12 requires refinishing or sharpening from time to time. The present invention is a sharpening device for sharpening the edge 12 of the veneer knife 10.

Figure 1:
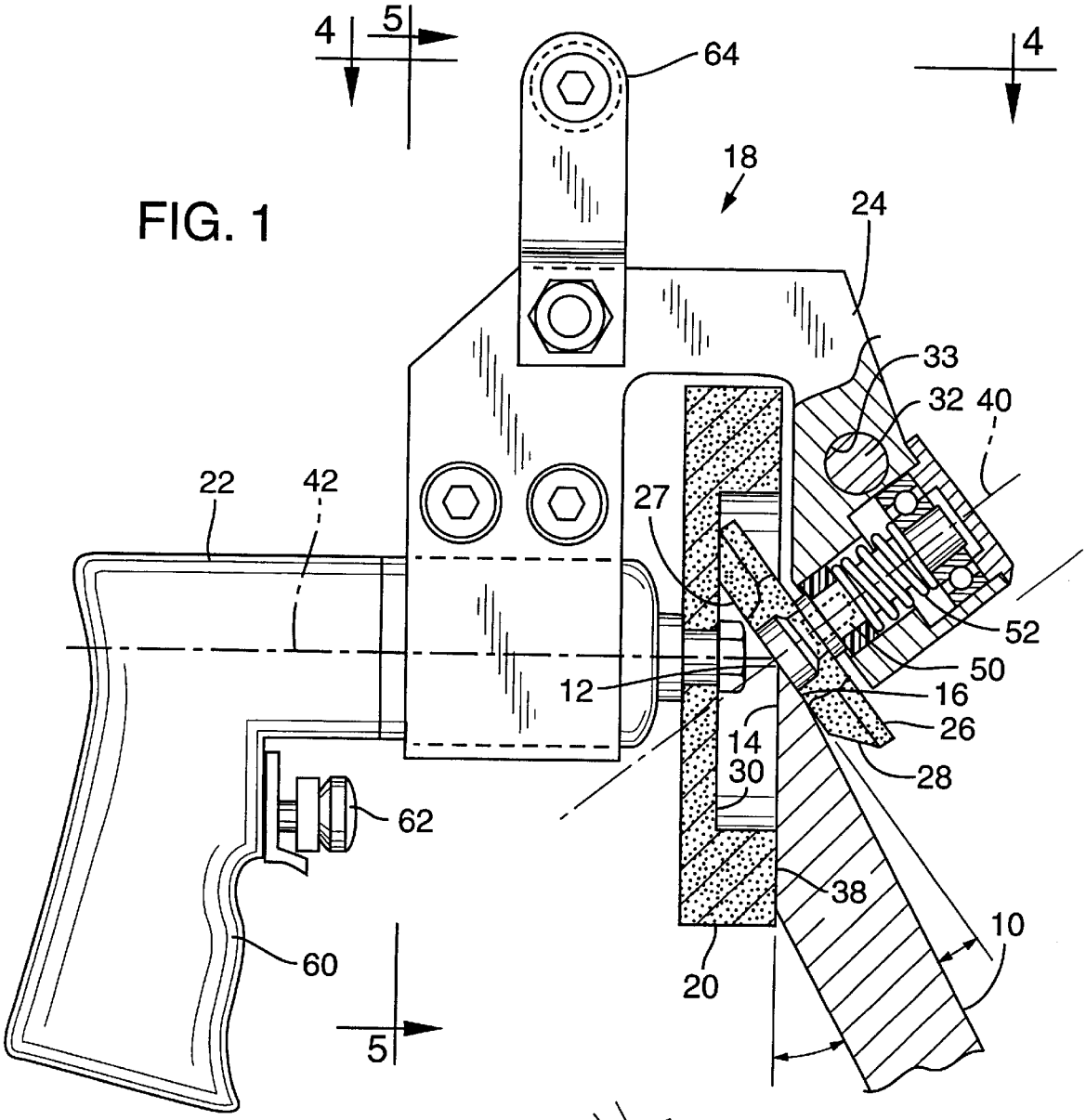
FIG. 1 is a view of a sharpening tool in accordance with the invention.
Figure 3:
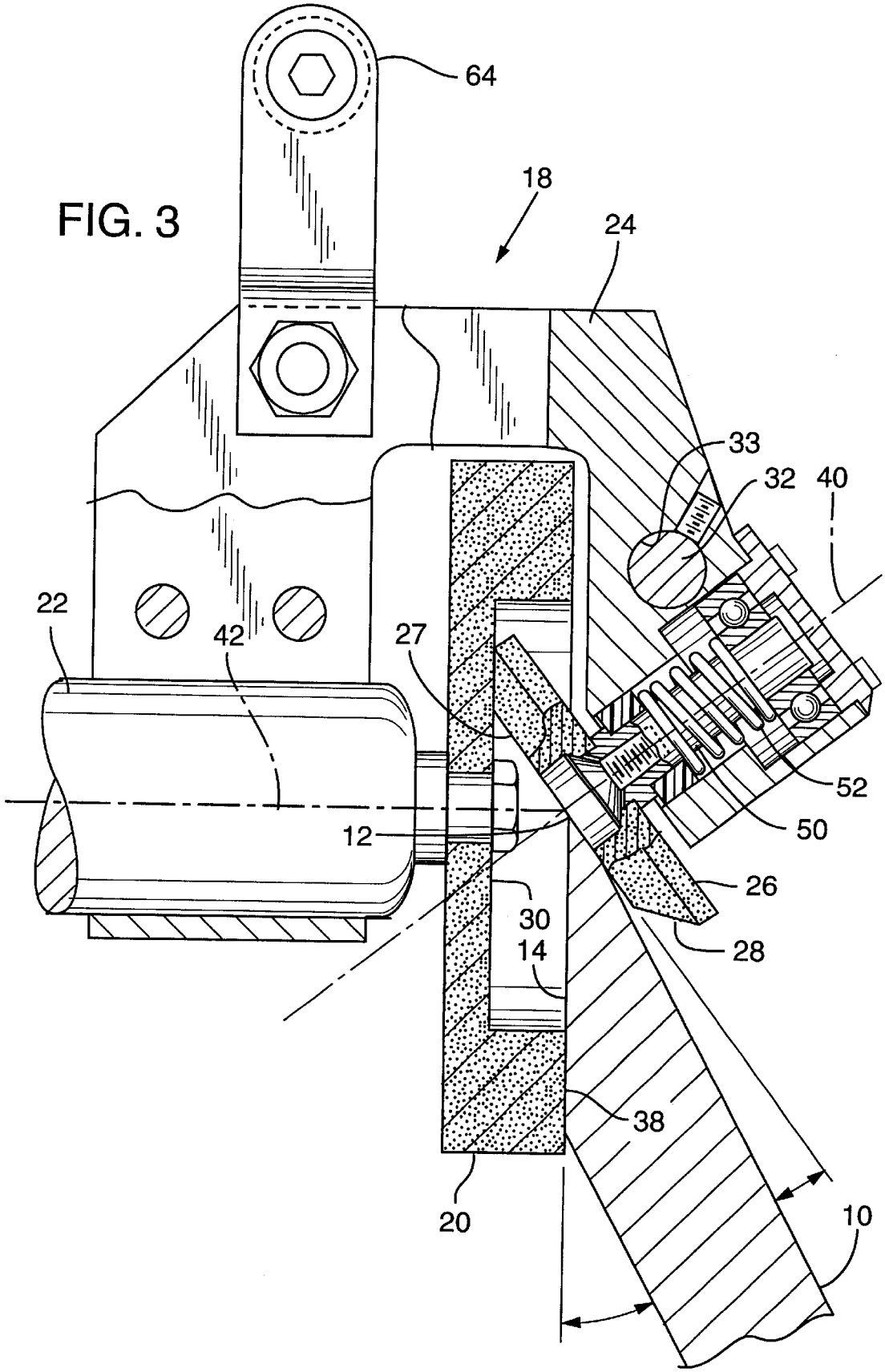
FIG. 3 is an enlarged partial view of the sharpening tool of FIG. 1.
Figure 4:
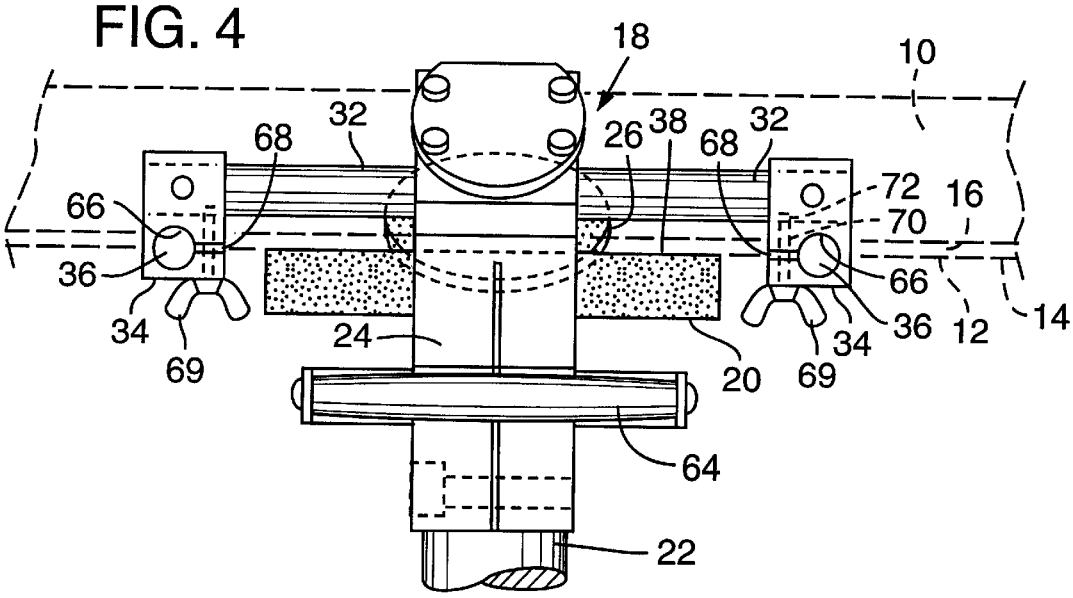
FIG. 4 is a view of the sharpening tool as viewed on view lines 4—4 of FIG. 1.

FIGS. 1 and 3 in conjunction with FIGS. 3 and 4 illustrate a sharpening tool 18 of the present invention. The tool 18 has a power head 22 (such as an air drill or the like) that rotatably supports and drives a primary stone 20. A bracket 24 is mounted to the body of the power head 22 and rotatably supports a secondary stone 26. The stone 26 is supported on a shaft 50. A spring 52 surrounding the shaft 50 forces the stone 26 mounted on the shaft 50 into contact with the primary stone 20. A face 28 of the stone 26 is forced into contact with the inset face 30 of the stone 20. Rotation of the primary stone 20 will thus force rotation of the secondary stone 26. As seen in the figures, the secondary stone 26 is inclined at an angle with respect to the primary stone 20. The axis 40 of the stone 26 is at an angle with respect to the axis 42 of the stone 20.

The power head 22 has a configured handle 60 to be gripped by an operator. A control 62 is provided in the handle 60 to control the operation of the power head 22. An auxiliary handle 64 is mounted to the bracket 24. An operator will grasp the handle 60 with one hand and grip the other handle 64 with the other hand for complete control of the tool 18.

The bracket 24 has a bore 33 in which a rod 32 is mounted. The rod 32 extends on each side of the bracket 24. Mounted to each end of the rod 32 are out rigger clamps 34. The clamps 34 have bores 66 in which posts 36 are adjustably mounted. A slot 68 extends from the side of the clamps 34 into the bore 66. A stud 70 is threadably installed in a bore 72 in the clamp 34. The posts 36 are clamped in position by a wing nut 69 fitted to the stud 70. Tightening the nut 69 will force the bore 66 to reduce to clamp the posts 36 in a set position.

Figure 6:
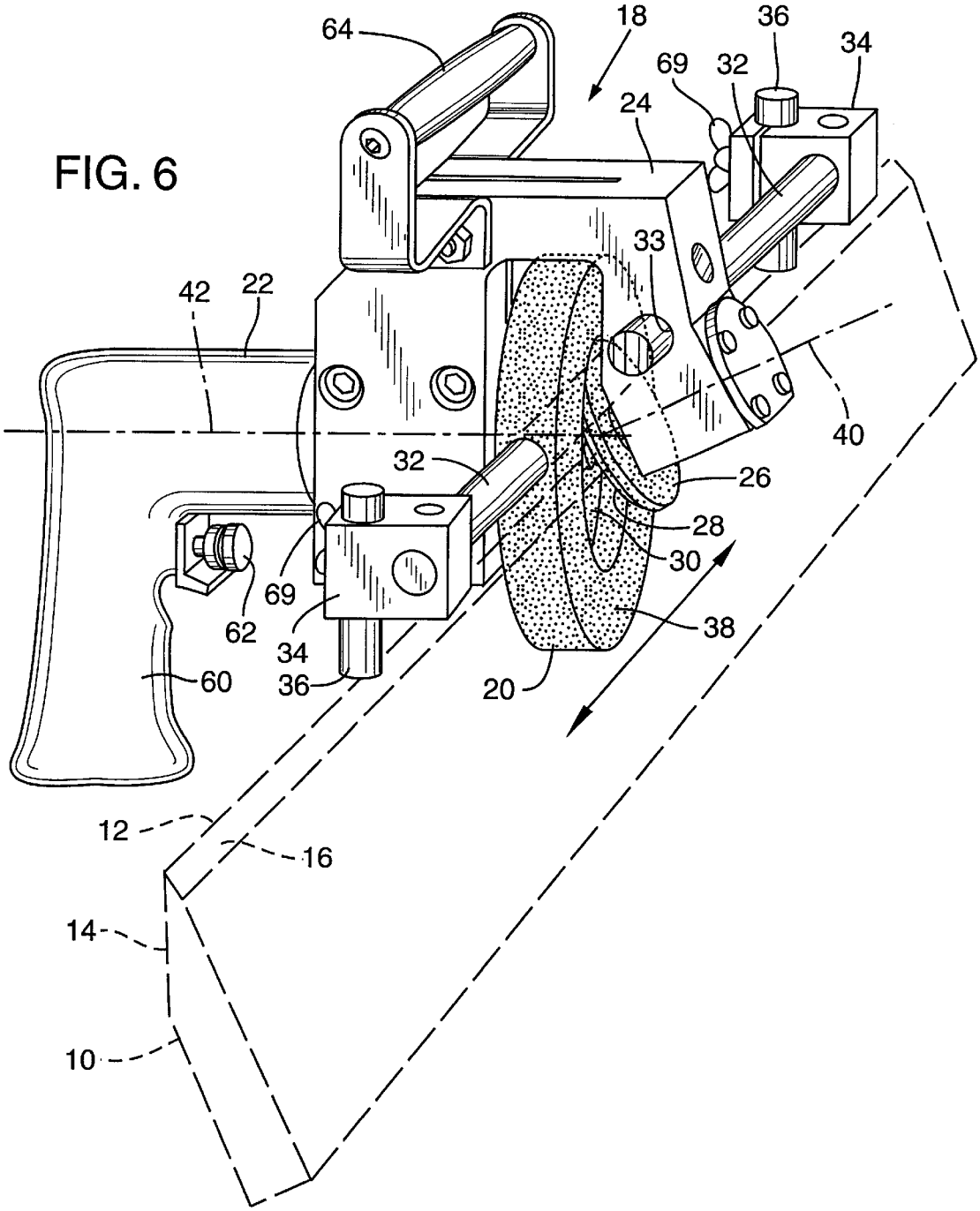
FIG. 6 is a perspective view of the sharpening tool of FIG. 1 applied to the veneer knife of FIG. 2.

Refer now to FIG. 6 of the drawings. The veneer knife 10 is sharpened by placing the tool 18 on the veneer knife 10. The primary stone is positioned against the face 14 which places the stone 26 into contact with the face 16 of the knife

Figure 5:
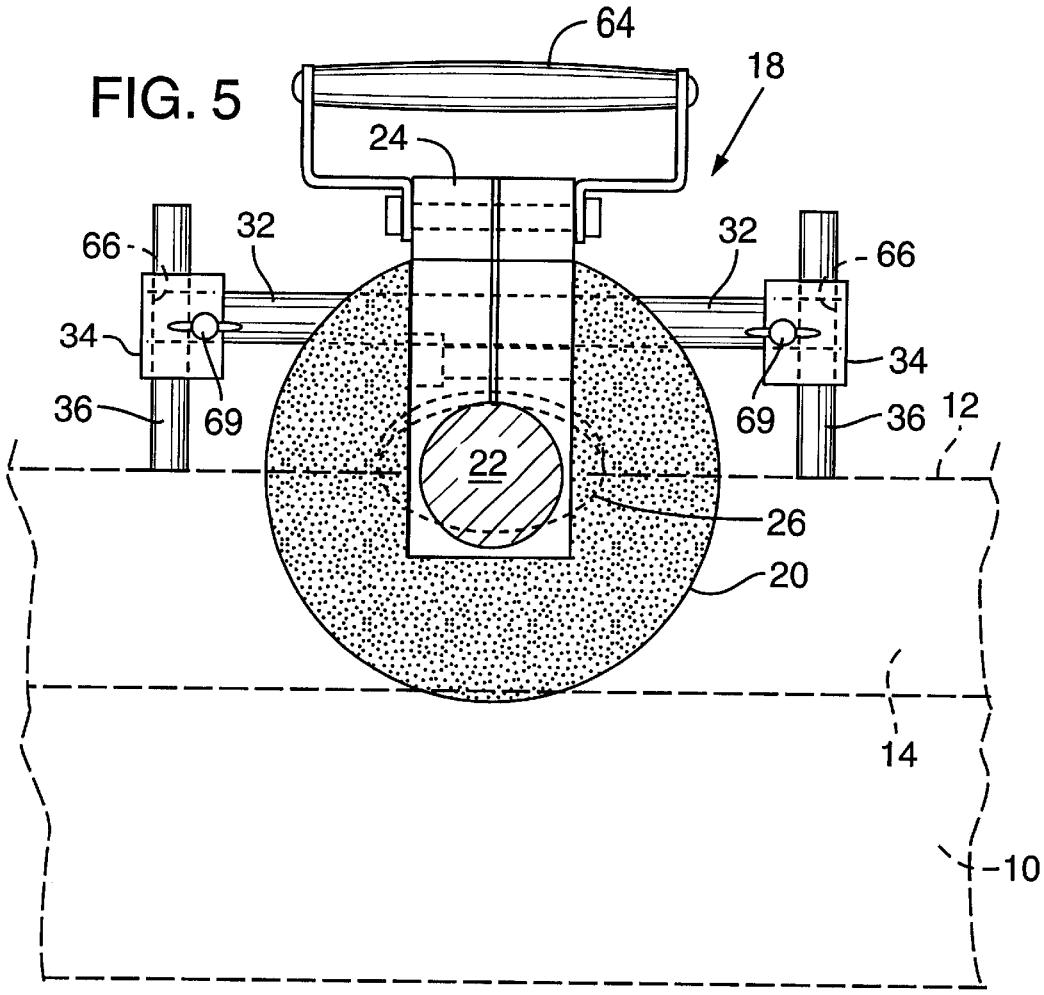
FIG. 5 is a view of the sharpening tool as viewed on view lines 5—5 of FIG. 1.

10. The cutting edge 12 will thus be positioned substantially at the intersection of the axes 40, 42. The positional relationship is further illustrated in FIGS. 4 and 5.

In this embodiment the stones 20, 26 are of cast iron and are of the type that will accept a grinding slurry, the slurry being similar to a common lapping compound. The slurry is applied to the face 38 of the stone 20 and to the face 27 of the stone 26. The slurry may also be applied along the lengths of the faces 14, 16 of the knife 10. The posts 36 are adjusted so that they are in close proximity to the cutting edge 12 of the knife 10 when the tool is desirably oriented relative to the knife.

The operator will grasp the handles 60, 64 to control the operation of the tool 18. Rotation of the stones 20, 26 is started by depressing the control 62 of the tool 18. The operator will move the tool along the length of the knife 10 while maintaining the posts 30 just out of contact with the edge 12.

It will be appreciated that the outrigger support posts 36 are not essential for the operation of the tool 18 but are provided as an aid in maintaining the proper alignment of the stones 20, 26 with the edges 14, 16 of the knife 10. Also, the posts could be configured to conform to or straddle the edge and ride in contact with the knife during sharpening.

Those skilled in the art will recognize that modifications and variations may be made without departing from the true spirit and scope of the invention. The invention is therefore not to be limited to the embodiments described and illustrated but is to be determined from the appended claims.

The invention claimed is:

1. A sharpener for sharpening an elongate knife edge defining an edge angle comprising:

a power head, a primary rotary sharpening stone that is disk shaped having a front side defining a front and a back side defining a back and an axis defining a center of rotation, said primary sharpening stone rotatably driven by the power head;

a bracket secured to the power head at the back of the primary sharpening stone and extended around said primary sharpening stone to the front of the primary sharpening stone;

a secondary sharpening stone that is disk shaped and is rotatably mounted to the bracket at the front of the primary sharpening stone, said secondary sharpening stone having a peripheral surface engaging the front side of the primary sharpening stone and rotatably driven around an axis of rotation by said primary sharpening stone;

said bracket, said secondary sharpening stone, and said primary sharpening stone cooperatively configured to define a primary sharpening surface and a secondary sharpening surface that intersects to define an angle mated to the edge angle of the knife edge.

2. A sharpener as defined in claim 1 wherein the sharpening surfaces are porous for absorbing and dispensing a sharpening slurry applied during a sharpening process.

3. A sharpener as defined in claim 2 wherein the sharpening stones are cast iron which material defines the porous surfaces.

4. A sharpener as defined in claim 1 wherein said front side of said primary sharpening stone has a center inset defining an inset surface and a rim surface, said inset surface being the surface engaged by the peripheral surface of said secondary sharpening stone and said rim surface being the primary sharpening surface.

5. A sharpener as defined in claim 4 wherein the primary sharpening surface and the secondary sharpening surface define intersecting planes that intersect along the knife edge during a sharpening process.

6. A sharpener as defined in claim 1 wherein a support rod extends laterally from the bracket above the knife edge and an outrigger defining a knife edge engaging surface is superimposed over the knife edge during a sharpening process.

7. A sharpener as defined in claim 2 wherein a pair of support rods carrying outriggers extend laterally in opposite directions from the bracket.

8. A sharpener as defined in claim 7 wherein a gauge member is adjustably secured to the support rod and forms a part of said outrigger of each of said outriggers and further provides a knife edge engaging surface, said gauge members adjusted to a position of close adjacency to the knife edge.

* * * * *